US012428194B2

(12) United States Patent
Joyce

(10) Patent No.: US 12,428,194 B2
(45) Date of Patent: Sep. 30, 2025

(54) CONTAINER ASSEMBLY

(71) Applicant: Pacific Southwest Container, LLC, Modesto, CA (US)

(72) Inventor: Tony Joyce, Oakdale, CA (US)

(73) Assignee: PACIFIC SOUTHWEST CONTAINER, LLC, Modesto, CA (US)

( * ) Notice: Subject to any disclaimer, the term of this patent is extended or adjusted under 35 U.S.C. 154(b) by 58 days.

(21) Appl. No.: 18/233,599

(22) Filed: Aug. 14, 2023

(65) Prior Publication Data

US 2024/0059450 A1 Feb. 22, 2024

Related U.S. Application Data

(60) Provisional application No. 63/398,422, filed on Aug. 16, 2022.

(51) Int. Cl.
*B65D 5/50* (2006.01)

(52) U.S. Cl.
CPC ..... *B65D 5/5052* (2013.01); *B65D 5/5004* (2013.01)

(58) Field of Classification Search
CPC .... B65D 5/5052; B65D 5/5004; B65D 5/504; B65D 5/5021; B65D 85/305; B65D 2251/07; B65D 5/5023; B65D 5/5011
USPC ..... 206/586, 429, 427, 168, 139
See application file for complete search history.

(56) References Cited

U.S. PATENT DOCUMENTS 1,681,287 A * 8/1928 French ..... B65D 5/5011 229/161
1,932,705 A * 10/1933 Menten ..... B65D 5/5052 206/418
2,090,882 A * 8/1937 Zimmerman ..... B65D 71/36 206/168
2,339,176 A * 1/1944 Lee ..... B65D 5/5038 206/427
2,426,899 A * 9/1947 Pantalone ..... B65D 5/504 493/162
2,706,590 A * 4/1955 Bergstein ..... B65D 5/5042 206/429

(Continued)

*Primary Examiner* — Anthony D Stashick
*Assistant Examiner* — Symren K Sanghera
(74) *Attorney, Agent, or Firm* — Jeffer Mangels; Butler & Mitchell LLP; Brennan C. Swain, Esq.

(57) ABSTRACT

A container assembly for securing one or more bottles that includes an outer box and an insert. The outer box includes a bottom portion, a top pivotably connected to the first wall of the bottom portion and a securing portion pivotably connected to one of the second, third or fourth walls. The securing portion includes a neck slot that is configured to receive the neck of the bottle when the securing portion is in the securing position. The insert includes an upper retainer portion having a neck retaining slot defined therein, a main panel and a lower retainer portion. The neck retaining slot or tunnel in the upper retainer portion is configured to receive the neck of the bottle. The lower retainer portion has a bottom retaining opening defined therein. The main panel extends between the upper and lower retainer portions. When the insert is received in the box interior, the securing portion is positioned over at least a portion of the insert in the securing position, and the top is positioned over the securing portion in the closed position.

9 Claims, 14 Drawing Sheets

(56) References Cited

U.S. PATENT DOCUMENTS 3,002,722 A * 10/1961 Cote ..... B65D 71/007 206/499
3,078,988 A * 2/1963 Dunning ..... B65D 71/40 206/429
3,397,772 A * 8/1968 Farquhar ..... B65D 5/5021 206/783
3,823,864 A * 7/1974 Ohkubo ..... B65D 5/38 229/172
4,049,116 A * 9/1977 Cope ..... B65D 71/0037 206/196
4,233,888 A * 11/1980 LaFleur ..... B65D 5/3685 493/132
4,300,683 A * 11/1981 Roccaforte ..... B65D 73/0085 248/152
4,303,153 A * 12/1981 Boulton ..... B65D 81/3851 206/139
4,341,308 A * 7/1982 Pasquini ..... B65D 5/5052 206/427
4,967,901 A * 11/1990 Wood ..... B65D 5/4608 206/139
5,402,889 A * 4/1995 Hermann ..... B65D 5/4233 206/443
5,484,053 A * 1/1996 Harris ..... B65D 71/48 206/149
5,494,166 A * 2/1996 Kuwata ..... B65D 5/5011 206/443
5,505,309 A * 4/1996 Taravella ..... B65D 5/504 493/56
5,813,523 A * 9/1998 Gnadt ..... B65D 5/5061 206/778
5,996,804 A * 12/1999 Kuhn ..... B65D 5/48048 206/593
7,004,314 B2 * 2/2006 Pucillo ..... B65D 5/5021 206/217
8,400,686 B2 * 3/2013 Mikajiri ..... B41J 2/473 358/484
11,577,880 B2 * 2/2023 Meuti ..... B65D 5/5038
11,873,144 B2 * 1/2024 Centofanti ..... B65D 5/5069
11,926,460 B2 * 3/2024 Ritchie ..... B65D 5/6635
2007/0138245 A1 * 6/2007 Mittelstaedt ..... B65D 5/2057 229/149
2007/0256952 A1 * 11/2007 Kim-Gifford ..... B65D 5/504 206/485
2013/0168277 A1 * 7/2013 Monti ..... B65D 5/48018 229/120.24
2016/0167857 A1 * 6/2016 Liu ..... B65D 5/04 229/103.2
2021/0394952 A1 * 12/2021 Chen ..... B65D 5/5014
2022/0089312 A1 * 3/2022 Meuti ..... B65D 5/504
2022/0144480 A1 * 5/2022 Royal ..... B65D 5/48044
2022/0315275 A1 * 10/2022 Rumsam ..... B65D 5/443
2023/0026698 A1 * 1/2023 Zheng ..... B65D 5/5016
2023/0097423 A1 * 3/2023 López Masagué .. B65D 5/6685 229/117.12
2023/0257181 A1 * 8/2023 Ritchie ..... B65D 5/6635

* cited by examiner

CONTAINER ASSEMBLY

CROSS-REFERENCE TO RELATED APPLICATIONS

This application claims the benefit of U.S. Provisional Application No. 63/398,422, filed on Aug. 16, 2022, the entirety of which is incorporated by reference herein.

FIELD OF THE INVENTION

The present disclosure relates to a container assembly, and more particularly to a container assembly for use in shipping bottles

BACKGROUND OF THE INVENTION

Historically, bottles and containers have been shipped in many styles and shapes of inner packaging using many different kinds of materials. The goal of these packages, was and is, to protect bottles and containers during rigorous parcel shipping conditions such as the Post Office, UPS, Fed Ex, etc. Few of those packages have been successful in their structural protection of the shipped product, as well as satisfying additional areas such as ease of assembly and packaging as well as cost effectiveness to purchase and minimizing environmental impacts.

Current prior art packaging suffers from numerous drawbacks. For instance, expanded polystyrene foam is not readily recyclable and such molded bottle protecting inserts tend to take up a large amount of space and to be expensive to manufacture. Other alternative solutions include utilizing the outer box with sufficient interior packaging media (e.g. foam pellets, wadded up newspaper, etc.) to protect the bottles. Shipping companies have an affinity for standardized packaging which allows for the possibility of ensuring the safe delivery of goods without concern for the effectiveness of the packing which has occurred. When bottles are packed within an outer box in a manner that is not highly standardized, the shipping company cannot determine whether mishandling during transport or inadequate packing has led to any claims of damage. By standardizing the packaging and designing the standardized packaging to meet the requirements of the shipping companies, claims of damage can be properly made to the truly responsible parties.

The background description includes information that may be useful in understanding the present invention. It is not an admission that any of the information provided herein is prior art or relevant to the presently claimed invention, or that any publication specifically or implicitly referenced is prior art.

SUMMARY OF THE PREFERRED EMBODIMENTS

In accordance with a preferred embodiment of the present invention there is provided a container assembly for securing a bottle having a bottom and a neck that includes an outer box and an insert. The out box includes a bottom portion having first, second, third and fourth walls and a bottom that cooperate to define a box interior, a top pivotably connected to the first wall of the bottom portion, wherein the top is movable between a closed position and an open position, and a securing portion pivotably connected to one of the second, third or fourth walls. The securing portion is movable between a non-securing position and a securing position. The securing portion includes a neck slot that is configured to receive the neck of the bottle when the securing portion is in the securing position. The insert includes an upper retainer portion having a neck retaining slot defined therein, a main panel and a lower retainer portion. The neck retaining slot or tunnel in the upper retainer portion is configured to receive the neck of the bottle. The lower retainer portion has a bottom retaining opening defined therein. The bottom retaining opening is configured to receive the bottom of the bottle. The main panel extends between the upper and lower retainer portions. When the insert is received in the box interior, the securing portion is positioned over at least a portion of the insert in the securing position, and the top is positioned over the securing portion in the closed position.

In a preferred embodiment, the securing portion includes a first panel that is pivotably connected to one of the second, third or fourth walls and a second panel that is pivotably connected to the first panel. The neck slot is defined in the second panel, and the second panel is positioned between the top retaining portion and the bottom retaining portion when the securing portion is in the securing position (it is also positioned between the bottle bottom and the upper retainer member. The upper retainer portion, lower retainer portion and main panel may be formed from a one-piece insert flat. One-piece means it the pieces and panels are integral with one another or formed from a single piece of cardboard or other material, as is known in the art. In another embodiment, the insert flat can be made of separate pieces. However, the term one-piece insert flat means that the folds, panels, openings, slots, etc. of the insert flat are all formed from the same piece of cardboard or other material.

Preferably, the upper retainer portion includes a first panel pivotably connected to the main panel, wherein the neck retaining slot is at least partially defined in the first panel of the upper retainer portion, wherein the lower retainer portion includes a first panel pivotably connected to the main panel, wherein the bottom retaining opening is defined in the first panel of the lower retainer portion. Preferably, the upper retainer portion includes a plurality of pivotably connected panels and a first neck retaining slot is defined in at least first and second of the panels of the upper retainer portion and a second neck retaining slot is defined in at least third and fourth panels of the upper retainer portion. The first neck retaining slot is aligned with the second neck retaining slot to define a neck retaining tunnel when the insert is in the assembled position. Put another way, the upper retainer portion is comprised of a series of rolled or folded panels that form an enclosed shape and are pivotably connected to the main panel. The lower retainer portion may also be comprised of a series of rolled panels that are pivotably connected to the main panel.

In accordance with another aspect of the present invention, there is provided a method of assembling an assembled insert from an insert flat. The insert is configured to secure at least a first bottle having a bottom and a neck. The method includes obtaining the insert flat. The insert flat includes a main panel, an upper retainer member and a lower retainer member. The upper retainer member includes a first panel pivotably connected to the main panel, a second panel pivotably connected to the first panel, a third panel pivotably connected to the second panel, a fourth panel pivotably connected to the third panel, a fifth panel pivotably connected to the fourth panel, and a sixth panel pivotably connected to the fifth panel. The pivotable connections between the panels may be referred to herein as folds. A first neck retaining slot is defined in the first and second panels of the upper retainer member and a second neck retaining slot is defined in the fifth and sixth panels of the upper retainer member. The lower retainer member includes a first panel pivotably connected to the main panel, a second panel pivotably connected to the first panel, and a third panel pivotably connected to the second panel. A first bottle bottom opening is defined in the first panel of the lower retainer member. The first to sixth panels (or any number in between) of the upper retainer member may all be connected at folds that are approximately parallel to one another. The first to sixth panels (or any number in between) of the lower retainer member may all be connected at folds that are approximately parallel to one another. In another embodiment, the upper and lower retainer members may include more panels.

The method includes forming the upper retainer member by folding the first panel approximately 90 degrees upwardly from the main panel, folding the second panel away from the main panel and approximately 90 degrees with respect to the first panel, folding the third panel downwardly from the second panel and approximately 90 degrees with respect to the second panel, folding the fourth panel toward the main panel and approximately 90 degrees with respect to the third panel, folding the fifth panel upwardly and approximately 90 degrees with respect to the fourth panel, such that the fifth panel is adjacent the first panel, and folding the sixth panel approximately 90 degrees with respect to the fifth panel, such that the sixth panel is adjacent the second panel. The first neck retaining slot and second retaining slot cooperate to define a neck retaining tunnel.

The method includes forming the lower retainer member by folding the first panel at an angle of between approximately 10 degrees and approximately 80 degrees (or between 25 degrees and 65 degrees) upwardly from the main panel, folding the second panel with respect to the first panel and away from the main panel such that the second panel is approximately parallel with the main panel, and folding the third panel downwardly from the second panel and approximately 90 degrees with respect to the second panel. Approximately as used herein means within 5-10 degrees.

In a preferred embodiment, the first panel of the upper retainer member includes a wing lock extending therefrom, the fifth panel of the upper retainer member includes a channel defined therein, and the method may further include inserting the wing lock into the channel to secure the upper retainer member in an assembly position. The lower retainer member may include a fourth panel pivotably connected to the third panel, or a fifth panel pivotably connected to the fourth panel, and/or a sixth panel pivotably connected to the fifth panel. The method includes the steps of folding the fourth panel toward the main panel and approximately 90 degrees with respect to the third panel, folding the fifth panel upwardly such that the fifth panel is adjacent the first panel, and folding the sixth panel such that the sixth panel is adjacent the second panel. The fourth panel can also be folded upwardly and connected to the second or third panel. The first panel of the lower retainer member may include a wing lock extending therefrom, the fifth panel of the upper retainer member includes a channel defined therein, and the method may further include inserting the wing lock into the channel to secure the lower retainer member in an assembly position.

In a preferred embodiment, a second bottle bottom opening is defined in the fifth panel of the lower retainer member, and the first bottle bottom opening is aligned with the second bottle bottom opening when the lower retainer member is in the assembly position. The method may include inserting the assembled insert into an outer box that includes a top and a securing portion, pivoting the securing portion from a non-securing position to a securing position, such that a neck slot defined in the securing position is aligned with the neck retaining tunnel, and pivoting the top to a closed position, wherein the top is positioned above the securing portion.

The following invention relates to boxes and corrugated paperboard boxes and packaging formed of corrugated paper-board and other similar planar panel-formed packaging material. More particularly, this invention relates to such packaging particularly configured for safely containing bottles with sufficient protection for the contained bottles to facilitate shipping without damage to the bottles contained therein.

A bottle support package or container assembly is provided that includes an outer box and insert to protect and hold at least one bottle within the outer box. The interior insert includes an upper retainer portion and a lower retainer portion to support the upper and lower portions of the bottle. The lower retainer portion may include an angled panel, that may be formed of planar corrugated paperboard material held up off of a lower end of the box. A hole or opening in this angled panel may receive a lower end of the bottle therein. In a preferred embodiment, material from the void left by the hole in the top panel provides additional support and protection for the lower portion of the bottles. The lower retainer portion can be fitted with multiple holes or openings and sized appropriately so that multiple bottles can be held by a single lower retainer (three are shown in the drawings). Where multiple bottles are being held, a flap may be provided that extends inwardly from a side leg that supports the top deck away from the lower end wall of the outer box. This flap supports the top deck to help keep it in proper position for supporting the lower ends of the bottles.

The upper retainer portion includes a main panel with one or more slots therein to receive necks of bottles passing therethrough. Preferably, the main panel is spaced from the upper end of the outer box by at least one spacing panel. The at least one spacing panel is preferably in the form of at least one panel extending between opposite walls of the outer box and generally perpendicular to the main panel to support the main panel spaced from the upper end wall of the outer box. Particular folding patterns and reinforcing layers are provided for the upper retainer portion and lower retainer portion so that the retainers can be formed from sheets of corrugated paperboard material or other similar material, and provide the requisite strength and shape to hold one or more bottles within the outer box in a manner preventing the bottles contained within the outer box from impacting walls of the outer box with the exception of the top of the outer box with sufficient force to break the bottles. It will be appreciated by those of ordinary skill in the art that the outer box is an adaptation of or related to the FEFCO universal standard commonly referred to as a RETF (roll end tuck front). This standard has been modified to include additional cushioning preventing bottles from contacting the top portion of the outer box as well as an additional panel that prevents the upper portion of the bottles from migrating while positioned in the insert. Together the outer box and insert form a system or assembly that provides protection for multiple bottles in transit.

Accordingly, a primary object of the present invention is to provide a bottle packaging enclosure which exhibits sufficient strength and flexibility to securely and safely hold a bottle without damage within an overall package for safe shipping of the bottle. Another object of the present invention is to provide a bottle shipping container which may satisfy shipping industry recognized drop tests. Another object of the present invention is to provide a bottle supporting enclosure which is economically feasible to manufacture. Another object of the present invention is to provide a bottle supporting enclosure that facilitates fast packing speeds for assembling the inner parts into the required outer box.

Another object of the present invention is to provide a bottle enclosure which may support different numbers of bottles in a flexible fashion within differently shaped outer boxes. Another object of the present invention is to provide a bottle support enclosure which may be stored flat before use, such that inventory space for the enclosures is minimized before use. Another object of the present invention is to provide a bottle support enclosure that resists damage to labels on the bottle. Another object of the present invention is to provide a bottle support enclosure which may be formed from standard corrugated paperboard cutting and creasing equipment. Another object of the present invention is to provide a bottle supporting enclosure which may be made of 100% recyclable and 100% biodegradable material. Another object of the present invention is to provide a solution that embodies all the above mentioned objectives while providing aesthetic features not found in currently available solutions. It will be appreciated that the objects of the invention discussed herein are only exemplary and are not limiting on the present invention.

A container assembly having a bottle support or insert and outer box is described herein in the form of a triple bottle enclosure (may be more or less than three). The enclosure includes an outer box having an orthorhombic shape. An insert (retainer) fits within a lower portion of the outer box. The lower retainer portion of the insert includes a top and angled panel or portion with holes defined in the angled panel to receive the lower ends of the bottles and to maintain the lower ends spaced from the walls of the outer box. An upper retainer portion (separated from the lower retainer portion by a main panel) also fits within an upper end of the outer box. The upper retainer portion includes a main panel with slots therein which are sized to receive necks of bottles passing therethrough. The securing portion keeps the necks of the bottles from impacting the upper end of the box and centered within the outer box. The upper and lower retainer portions are preferably formed of planar panels of rigid material, such as corrugated paperboard, cut and folded to form the upper and lower retainer portions.

Other further objects of the present invention will become apparent from a careful reading of the included drawing figures, the claims and detailed description of the invention.

BRIEF DESCRIPTION OF THE DRAWINGS

The disclosure may be more readily understood by referring to the accompanying drawings in which.

DETAILED DESCRIPTION OF THE PREFERRED EMBODIMENTS

Figure 1:
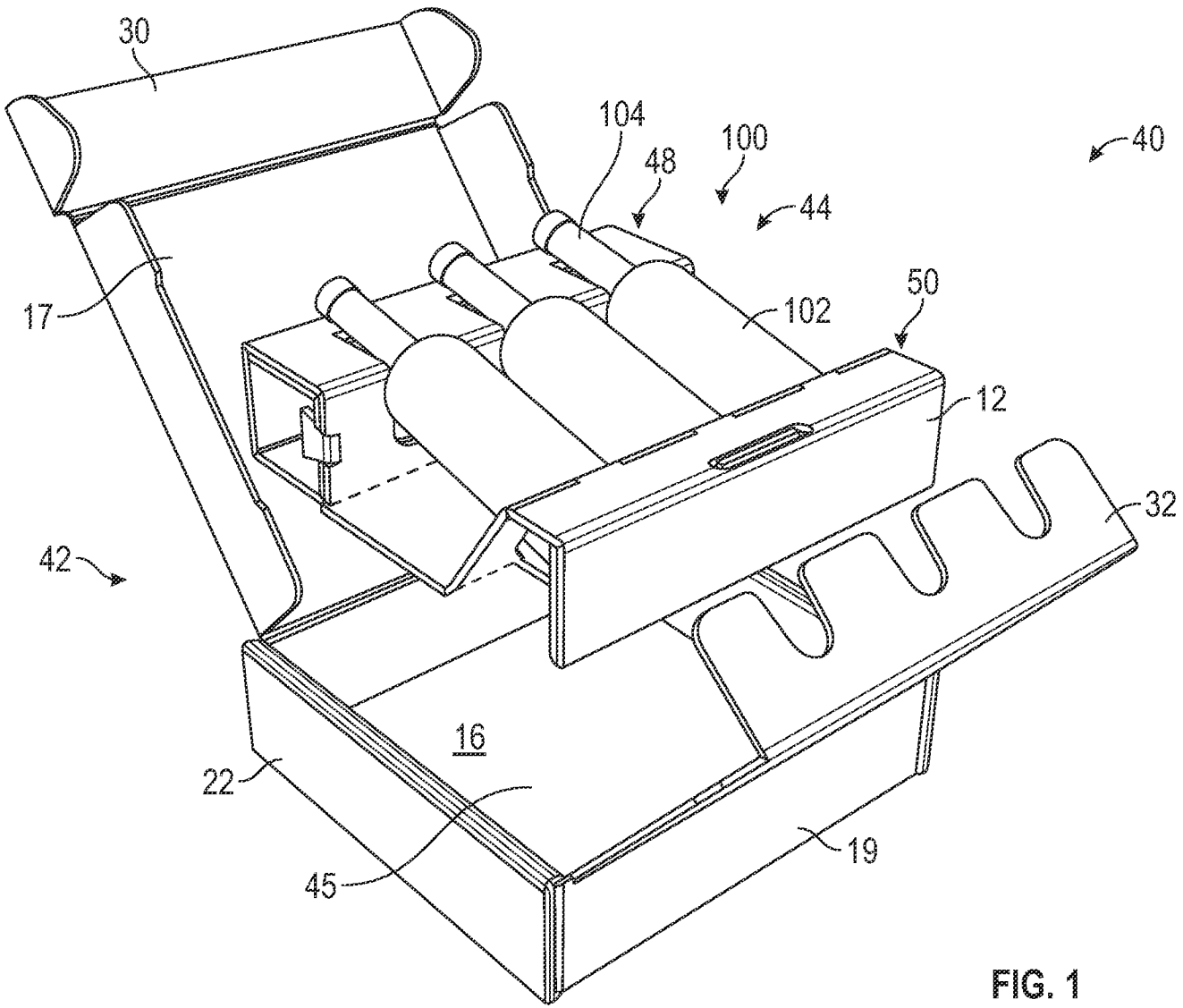
FIG. 1 is an exploded perspective view of a container assembly showing an insert together with three bottles therein exploded from the outer box in accordance with a preferred embodiment of the present disclosure.

The following description and drawings are illustrative and are not to be construed as limiting. Numerous specific details are described to provide a thorough understanding of the disclosure. However, in certain instances, well-known or conventional details are not described in order to avoid obscuring the description. References to one or an embodiment in the present disclosure can be, but not necessarily are references to the same embodiment; and, such references mean at least one of the embodiments. If a component is not shown in a drawing then this provides support for a negative limitation in the claims stating that that component is "not" present. However, the above statement is not limiting and in another embodiment, the missing component can be included in a claimed embodiment.

Reference in this specification to "one embodiment," "an embodiment," "a preferred embodiment" or any other phrase mentioning the word "embodiment" means that a particular feature, structure, or characteristic described in connection with the embodiment is included in at least one embodiment of the-disclosure and also means that any particular feature, structure, or characteristic described in connection with one embodiment can be included in any embodiment or can be omitted or excluded from any embodiment. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others and may be omitted from any embodiment. Furthermore, any particular feature, structure, or characteristic described herein may be optional. Similarly, various requirements are described which may be requirements for some embodiments but not other embodiments. Where appropriate any of the features discussed herein in relation to one aspect or embodiment of the invention may be applied to another aspect or embodiment of the invention. Similarly, where appropriate any of the features discussed herein in relation to one aspect or embodiment of the invention may be optional with respect to and/or omitted from that aspect or embodiment of the invention or any other aspect or embodiment of the invention discussed or disclosed herein.

The terms used in this specification generally have their ordinary meanings in the art, within the context of the disclosure, and in the specific context where each term is used. Certain terms that are used to describe the disclosure are discussed below, or elsewhere in the specification, to provide additional guidance to the practitioner regarding the description of the disclosure. For convenience, certain terms may be highlighted, for example using italics and/or quotation marks: The use of highlighting has no influence on the scope and meaning of a term; the scope and meaning of a term is the same, in the same context, whether or not it is highlighted.

It will be appreciated that the same thing can be said in more than one way. Consequently, alternative language and synonyms may be used for any one or more of the terms discussed herein. No special significance is to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and is not intended to further limit the scope and meaning of the disclosure or of any exemplified term. Likewise, the disclosure is not limited to various embodiments given in this specification.

Without intent to further limit the scope of the disclosure, examples of instruments, apparatus, methods and their related results according to the embodiments of the present disclosure are given below. Note that titles or subtitles may be used in the examples for convenience of a reader, which in no way should limit the scope of the disclosure. Unless otherwise defined, all technical and scientific terms used herein have the same meaning as commonly understood by one of ordinary skill in the art to which this disclosure pertains. In the case of conflict, the present document, including definitions, will control.

It will be appreciated that terms such as "front," "back," "top," "bottom," "side," "short," "long," "up," "down," "aft," "forward," "inboard," "outboard" and "below" used herein are merely for ease of description and refer to the orientation of the components as shown in the figures. It should be understood that any orientation of the components described herein is within the scope of the present invention.

Figure 2:
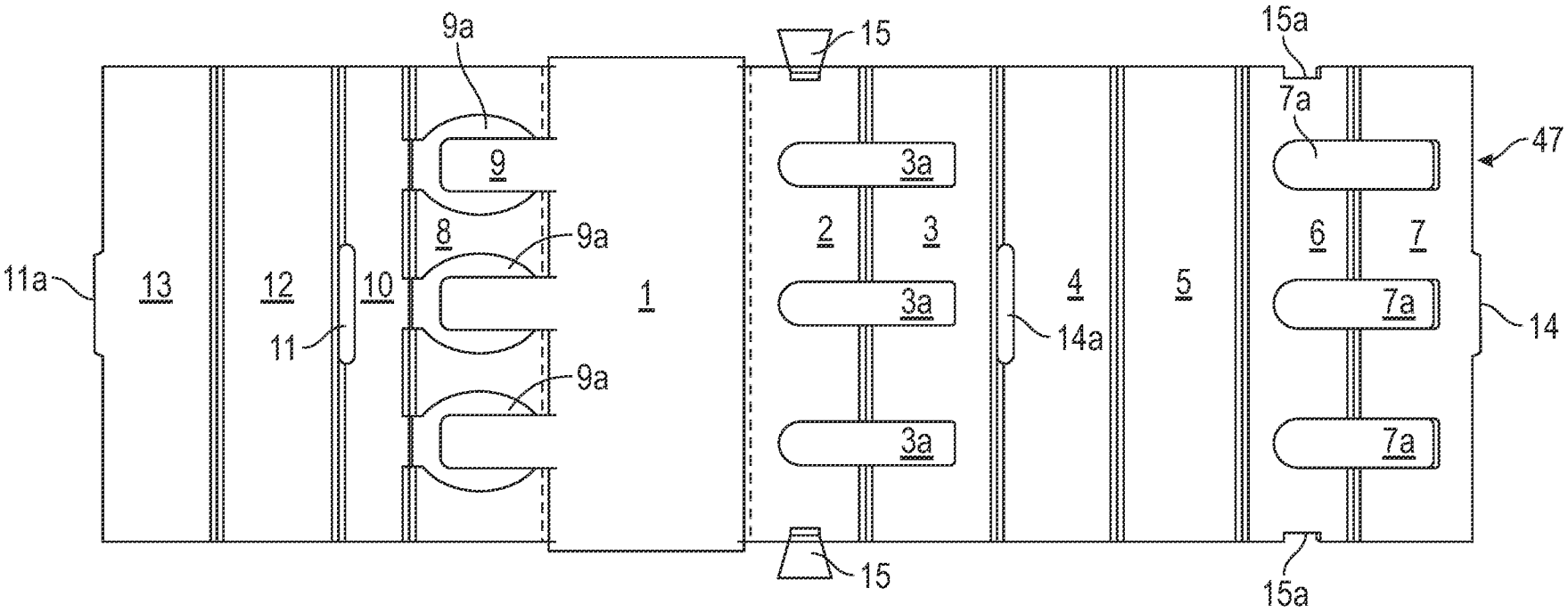
FIG. 2 is a plan view of the insert flat.
Figure 2A:
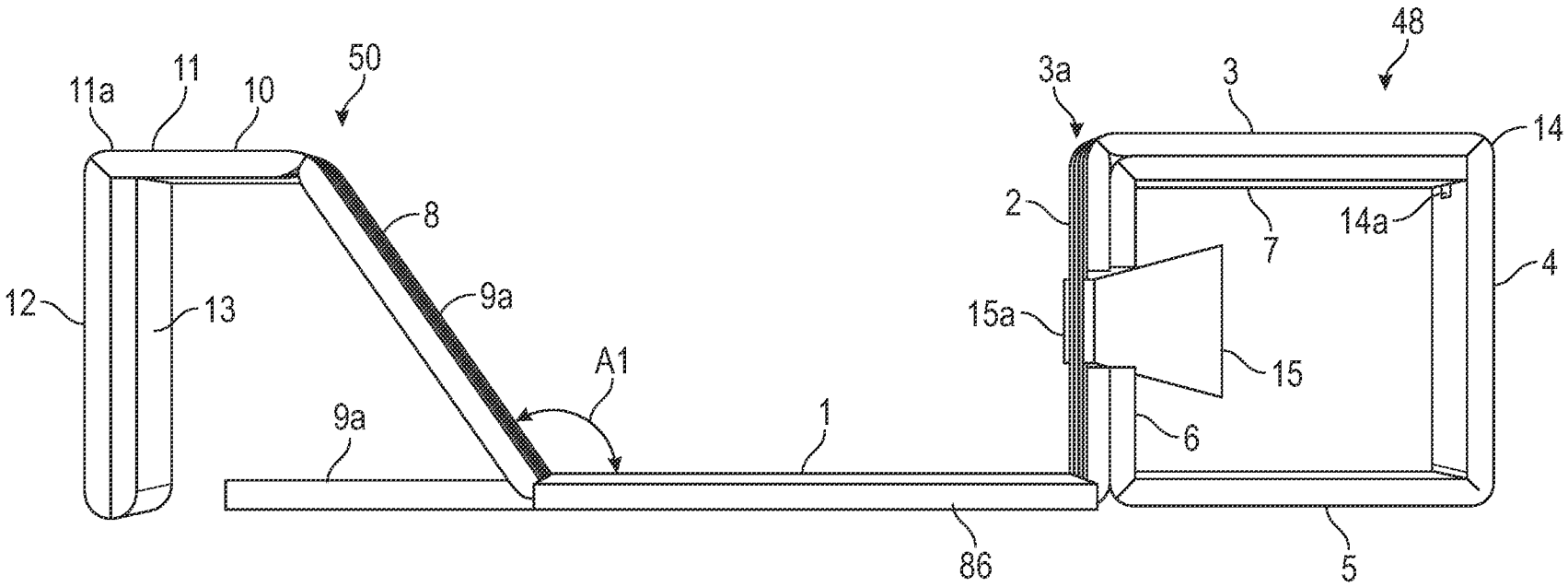
FIG. 2*a* is a side perspective view of the insert of FIG. 2 after it has been assembled from the insert flat.
Figure 2B:
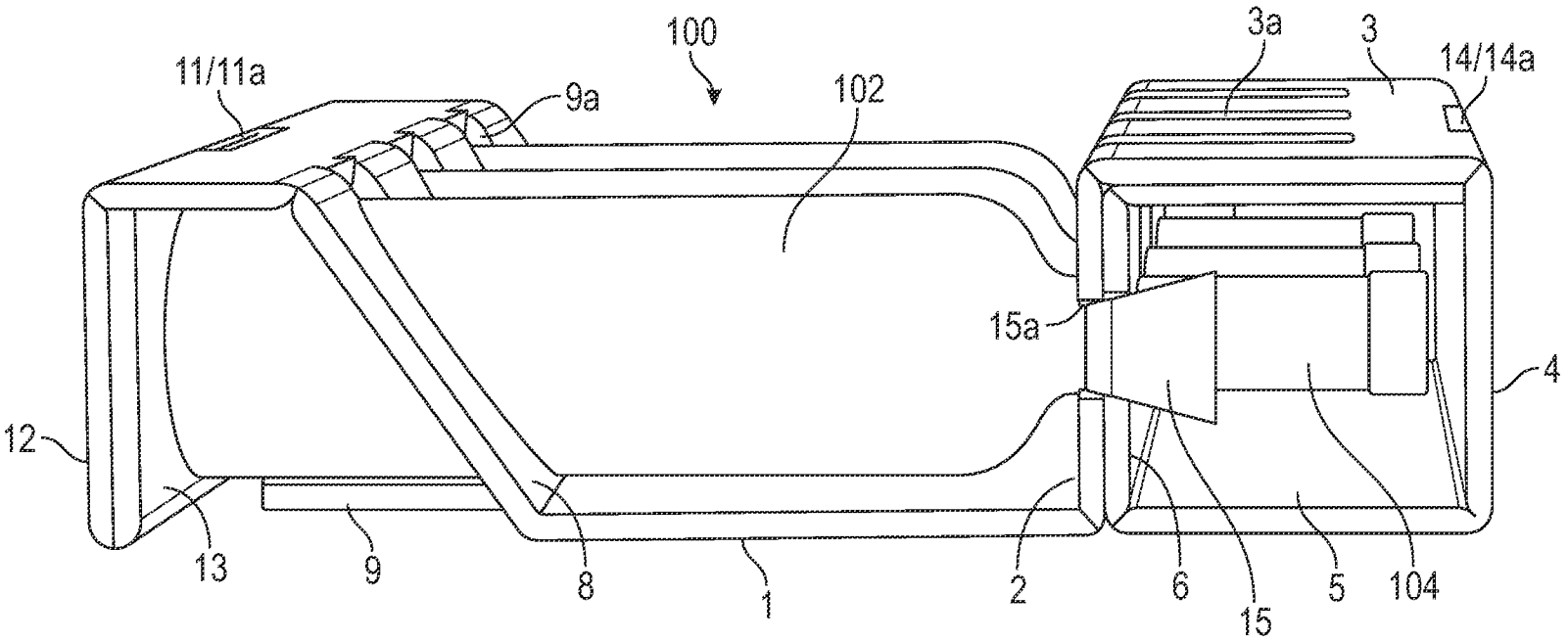
FIG. 2B is a side perspective view of the insert with bottles received therein.
Figure 3:
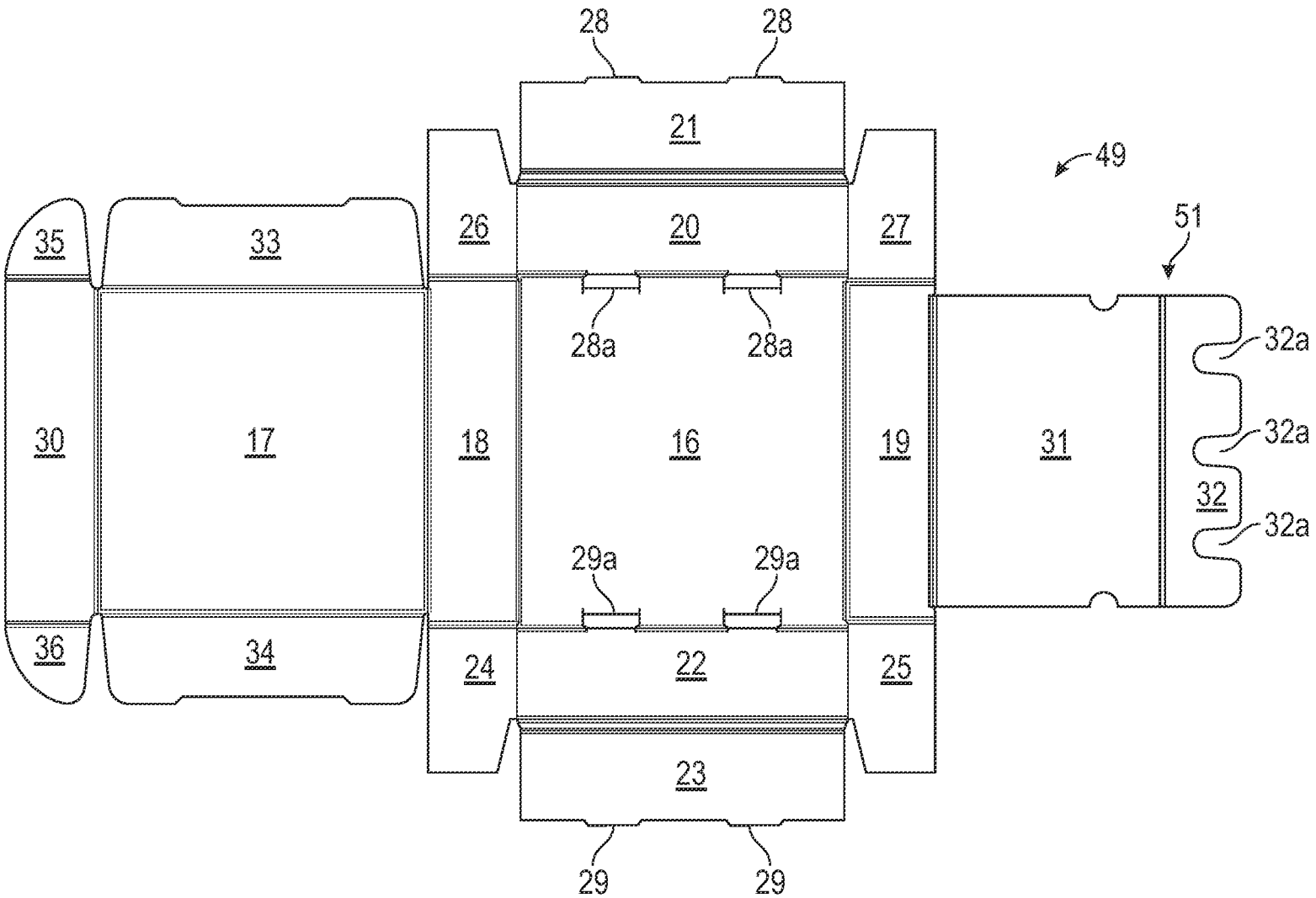
FIG. 3 is a plan view of the outer box flat.

FIGS. 1-5 show a container assembly 40 that includes an outer box 42 and insert 44. The bottles 100 (which include a bottom 102 and a neck 104) are received in insert 44, and insert 44 is received in box interior 45. As shown in FIG. 1, the insert 44 is insertable into (and removable from) outer box 42. In a preferred embodiment, both the outer box 42 and insert 44 begin as a flat. The insert flat 47 is shown in FIG. 2 and the outer box flat 49 is shown in FIG. 3. It will be appreciated that the insert is numbered 44 in the assembled condition or position and is numbered 47 in the flat condition or position. FIGS. 2, 2*a*, and 2*b* show the insert flat 47 in the flat condition (FIG. 2), the assembled condition (FIG. 2A) and with bottles inserted therein (FIG. 2B). Preferably, the insert flat and final assembled insert flat are formed from a single piece of material. Preferably, the outer box flat and final assembled outer box are formed from a single piece of material. However, separate pieces of material may be glued or otherwise adhered to one another to form the insert and the outer box.

FIGS. 2-2B together show the assembly of insert flat 47 into assembled insert 44. To form the upper retainer portion 48, panel 2 folds 90° from main panel 1. In use, the bottle shoulders rest against panel 2. Panel 3 folds 90° from panel 2. A first set of neck retaining slots 3*a* are formed in panels 2 and 3, and when panels 2 and 3 are folded with respect to one another, neck retaining slots 3*a* take the shape shown in FIG. 4 (together with the second set of neck retaining slots 7*a*, which are formed in panels 6 and 7). Panel 2 forms an inner wall of upper retainer portion 48 and exposes the bottle necks 104 (through slots 3*a*). Panel 4 folds 90° from panel 3 (and opposes panel 2). Panel 3 forms the top wall of upper retainer portion 48. Panel 5 folds 90° from panel 4. Panel 4 is or forms the outer wall of upper retainer portion 48. Panel 6 folds 90° from panel 5. Panel 6 is a re-enforcement for panel 2. Panel 7, folds 90° from panel 6. Panel 7 acts as a brace for panel 5 keeping panel 5 rigid against panel 1. Slots 7*a* align with slots 3*a* and receive the bottle necks during use. Tab 14 extends from panel 7 and corresponding slot 14*a* is defined in panel 4. Tab 14 is received in slot 14*a* to help secure upper retainer portion in the proper position and insure panel 7 cannot pivot out of position in panel 4. Tab or wing lock 15 is received in corresponding allowance or channel 15*a* and helps keep panels 2 through 7 in rolled form, as shown in FIG. 2*a*. This allows the insert to be handled while maintaining the functionality of the combined panels 2 through 7.

To form the lower retainer portion 50, panel 8 is back folded to achieve the appropriate angle (see angle A1 in FIG. 2*a*) necessary to accommodate the diameter of the inserted bottles (which can be any angle between 1° and 90°). Extensions 9 are continuations of or extend from panel 1 and reside under the heel of the inserted bottles providing added protection beyond the protection the outer box 42 provides. Voids or bottom bottle openings 9*a* are defined in panel 8 and provide a contour around the body of the inserted bottles aiding in the orientation, separation, and protection for the inserted bottles in transit. Panel 10 folds counter to panel 8 (which includes bottle bottom openings 9*a* defined therein) and, in use, acts to provide added protection beyond the protection of the outer box 42. Panel 12 folds 90° from panel 10 and is the outer most portion of protection for the bottom 102 of the bottles 100. Panel 13 folds 180° from panel 12 and is the inner most portion of protection for the bottom of the bottles. Tab 11*a* is inserted into slot 11. See FIG. 6 below for a possible addition to lower retainer portion 50.

With reference to FIG. 3 and the outer box 42, panel 16 is or forms the bottom of the outer box. Panel 18 is or forms the rear panel or wall and folds 90° from panel 16. Panel 19 is or forms the front panel or wall and folds 90° from panel 16. Panels 24, 25, 26 and 27 fold 90° from panels 18 and 19 respectively. Panels 20 and 21 fold 90° from panel 16 around panels 26 and 27 on one side and panels 22 and 23 fold 90° from panel 16 around panels 24 and 25 on the other side to form the left and right sides of the outer box. Tabs 28 and 29 engage into slots 28*a* and 29*a*, respectively, when panels 21 and 23 are folded in the previous step. The tabs received in the slots helps secure the side walls in place. When assembled, the outer box includes a bottom portion having first, second, third and fourth walls and a bottom (panel 16) that cooperate to define the box interior 45. The top (e.g., panels 17, 30, 33, 34, 35 and 36) is pivotably connected to the first wall of the bottom portion and is movable between a closed position and an open position.

Figure 4:
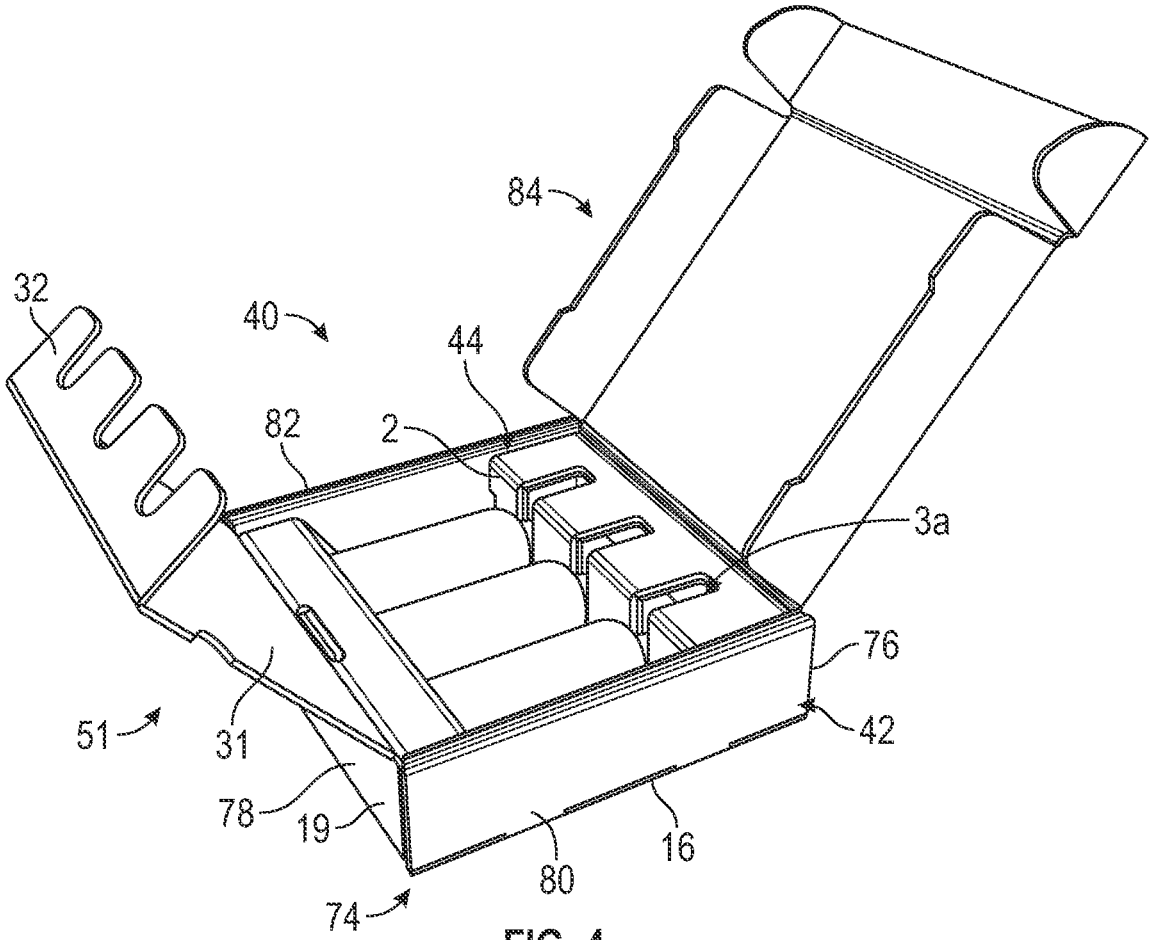
FIG. 4 is a perspective view of the container assembly with the outer box top in the open position and the securing portion in the non-securing position.
Figure 5:
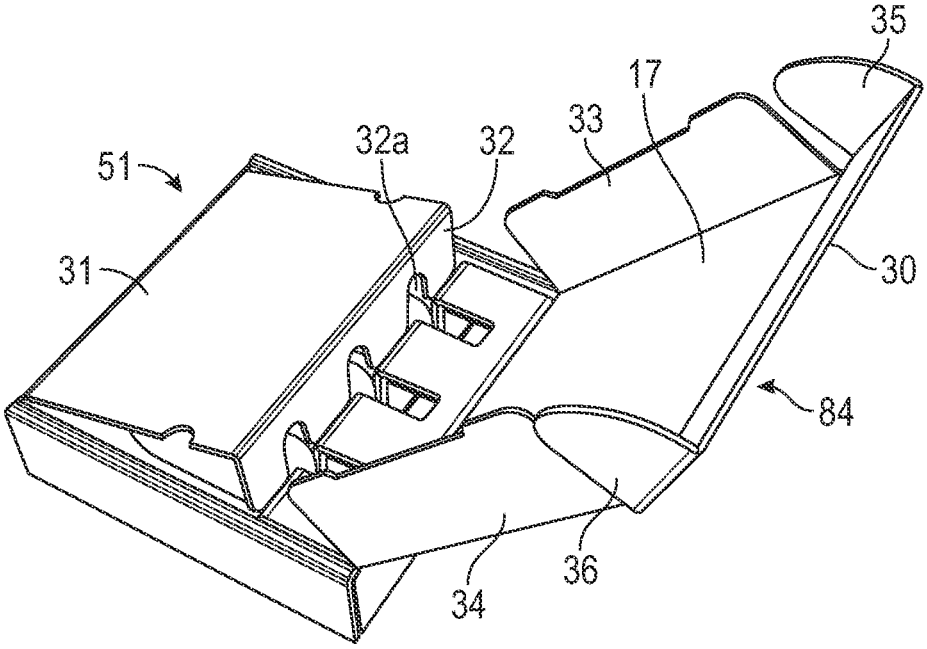
FIG. 5 is another perspective view of the container assembly with the outer box top in the open position and the securing portion being placed in the securing position.

After assembly of the outer box 42, as shown in FIGS. 1, 4 and 5, insert 44 is inserted into the outer box 42 with panel 12 facing towards panel 19 (see FIG. 1). The bottle bottoms are then inserted into voids or bottom openings 9*a* in panel 8 and the bottle necks are inserted into slots 3*a* (see FIG. 2*b*), which are defined in panels 2 and 3 (and slots 7*a*, which are defined in panels 6 and 7) on insert 44.

Next, the securing portion 51 is positioned to secure the insert 44 and bottles within the box interior. This is done by folding panels 31 and 32 from panel 19 and slots 32*a* on panel 32 are inserted over and receive the bottle necks. The slots 32*a* generally correspond to the neck of the inserted bottles when folded. After insertion, panel 32 is adjacent to and/or against panel 2. The securing portion 51 helps hold the bottles in place during shipping and transport and panel 32, with the bottle necks extending through slots 32*a* helps prevent the bottles from traveling vertically (upwardly as FIG. 4 is oriented) in transit.

Lastly, the top of the outer box is closed. Panels 33 and 34 are dust flaps and fold 90° from panel 17. Panel 17 is the top of the outer box and folds 90°. Panel 30 is the front outer panel and folds 90°. Panels 35 and 36 are inserted into the gap created between panels 24, 25, 26 and 27 and panels 20 and 22 when securing the outer box 42 and container assembly 40 closed.

Figure 6:
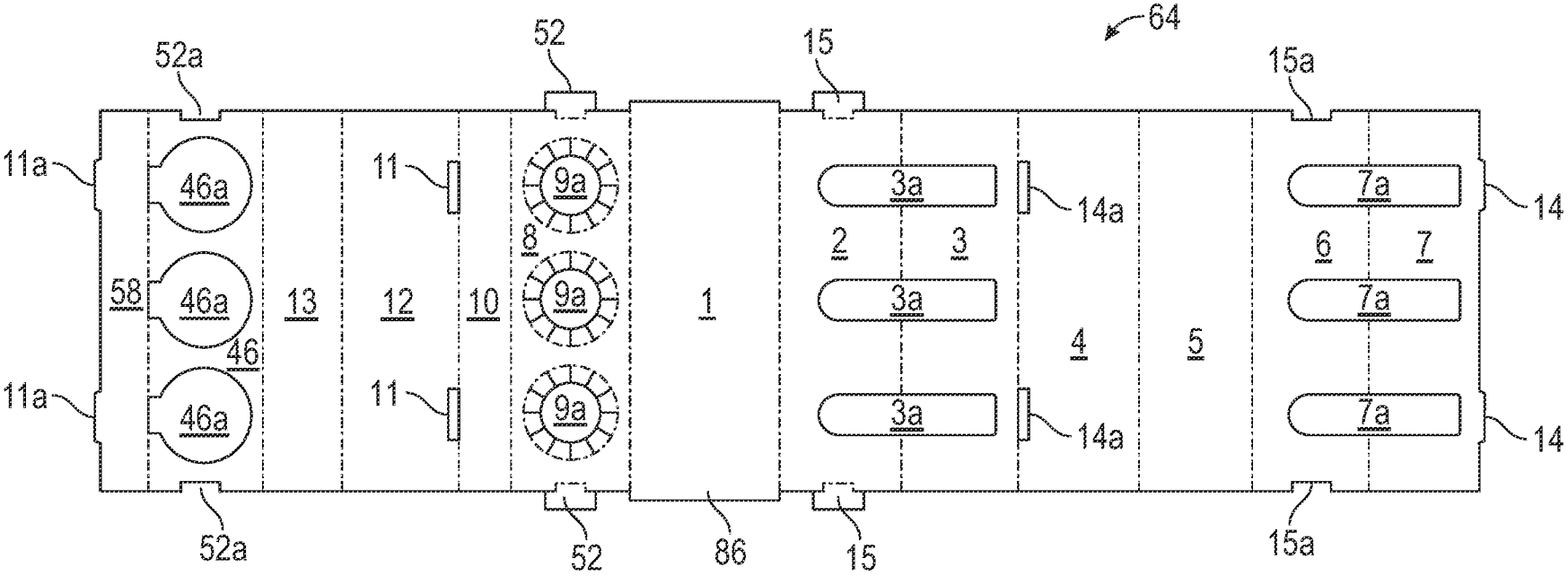
FIG. 6 is a plan view of another insert flat in accordance with a preferred embodiment of the present invention.
Figure 7:
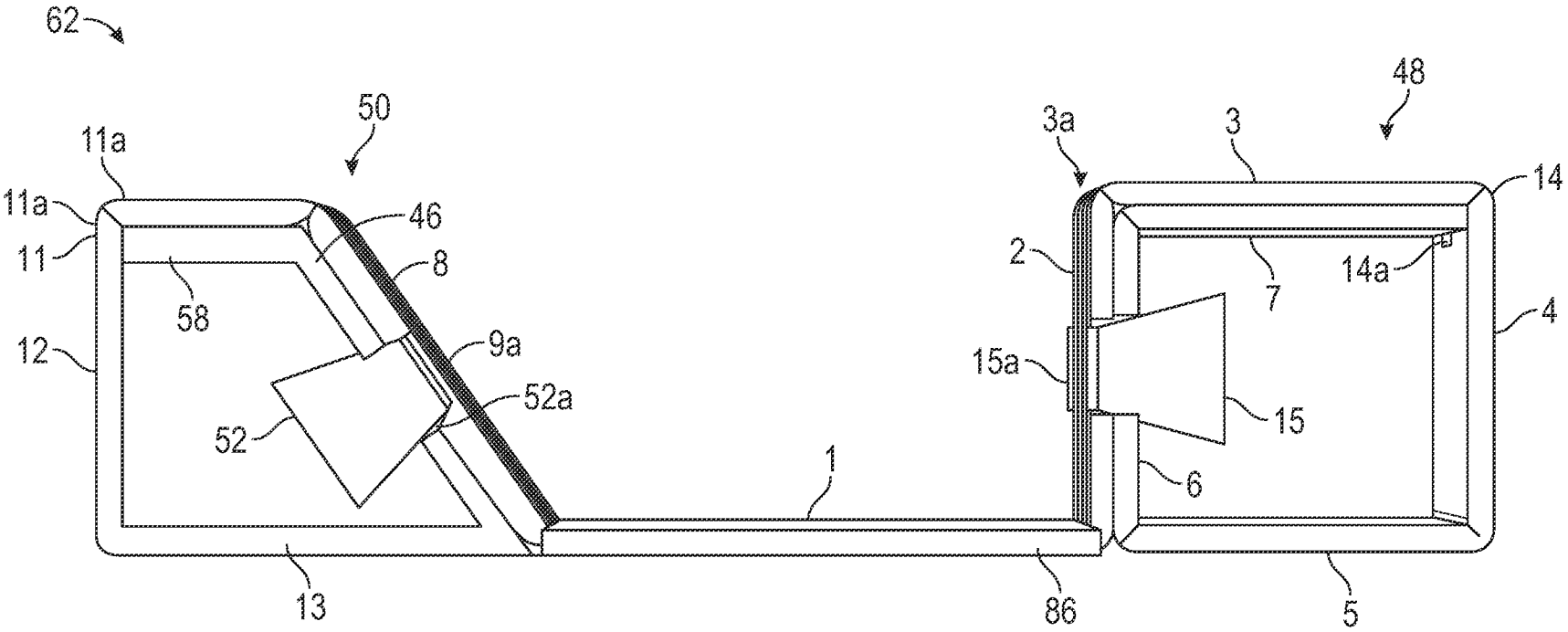
FIG. 7 is a side perspective view of an insert similar to the insert flat of FIG. 6 after it has been assembled.
Figure 8:
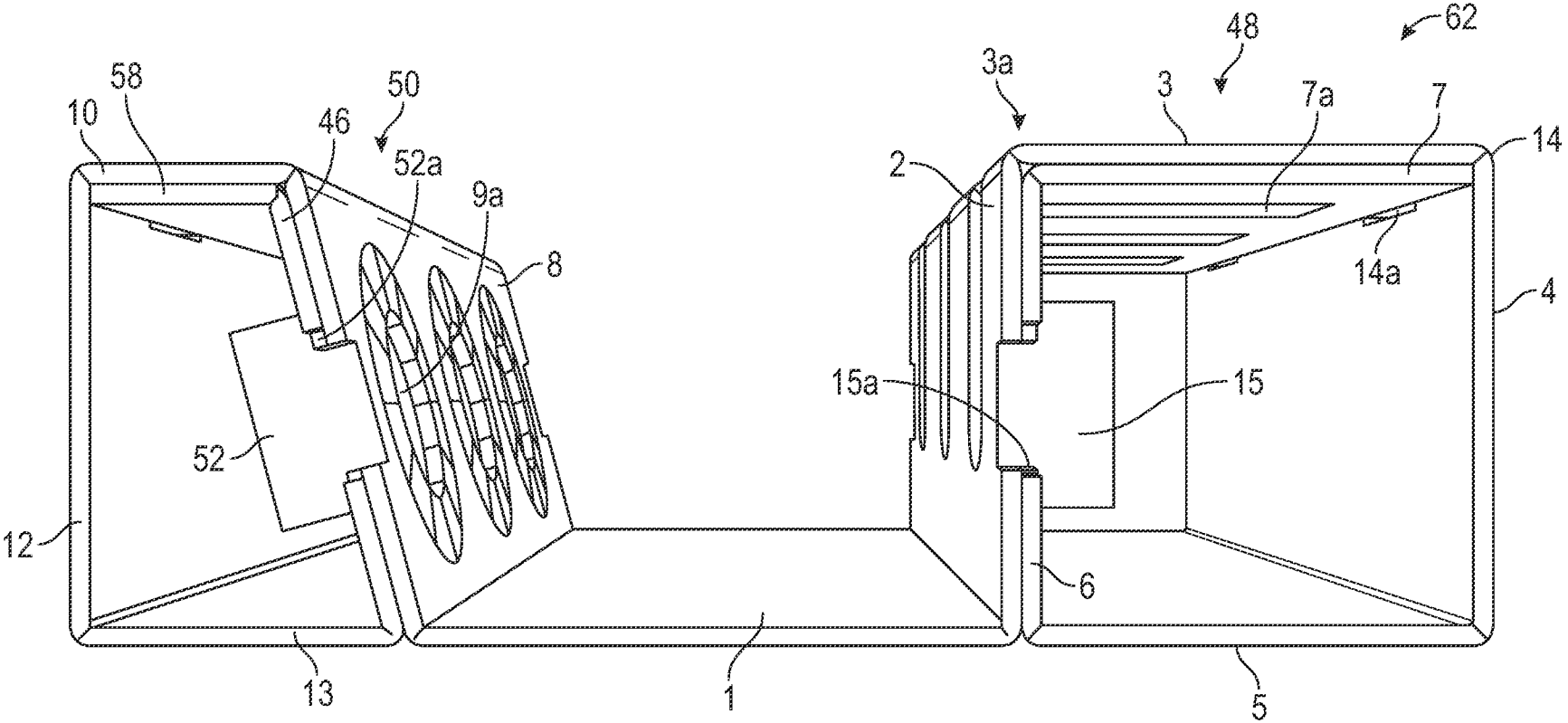
FIG. 8 is a side perspective view of the insert of FIG. 6 after it has been assembled from the insert flat.
Figure 9:
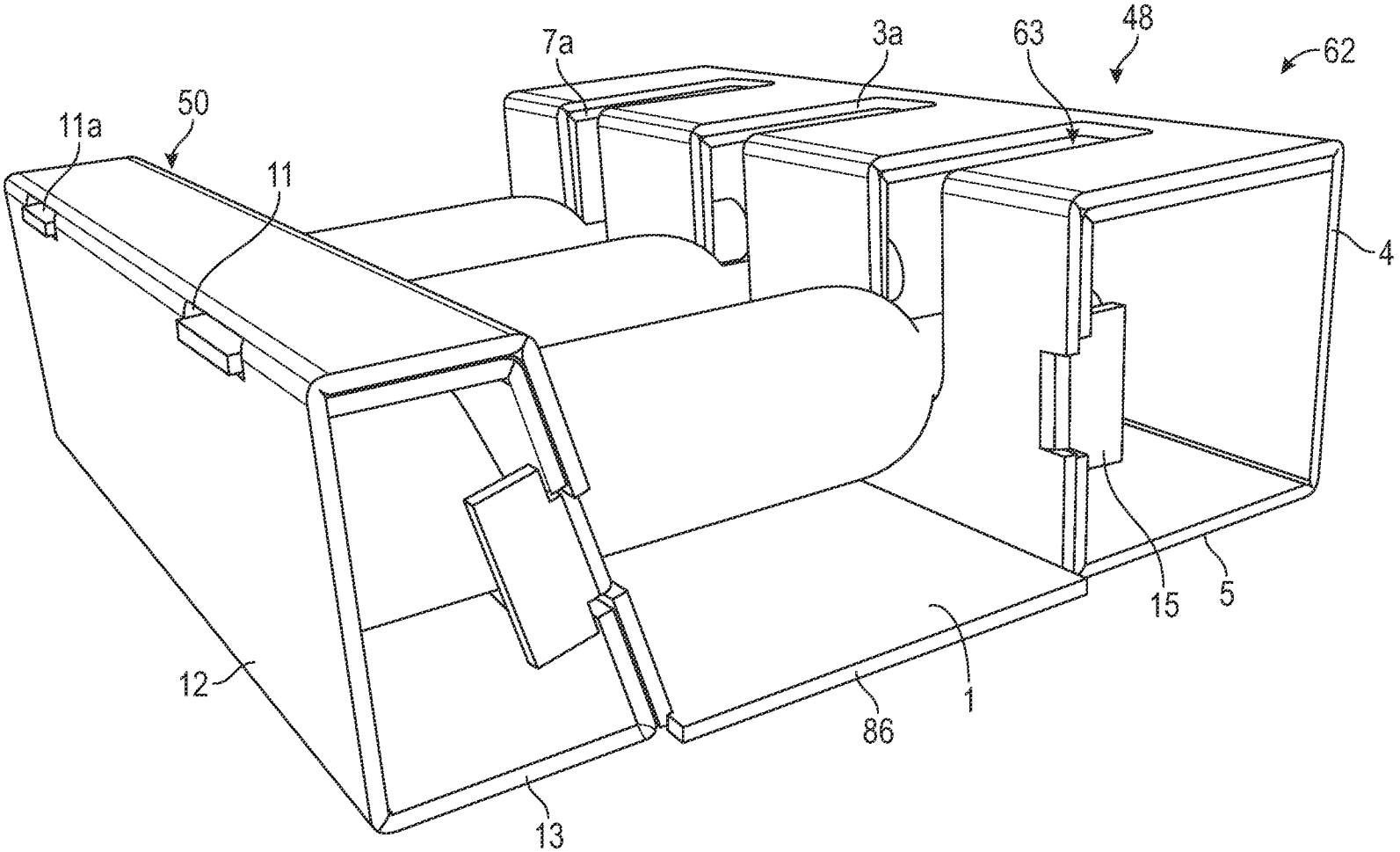
FIG. 9 is a side perspective view of the insert with bottles received therein.
Figure 10:
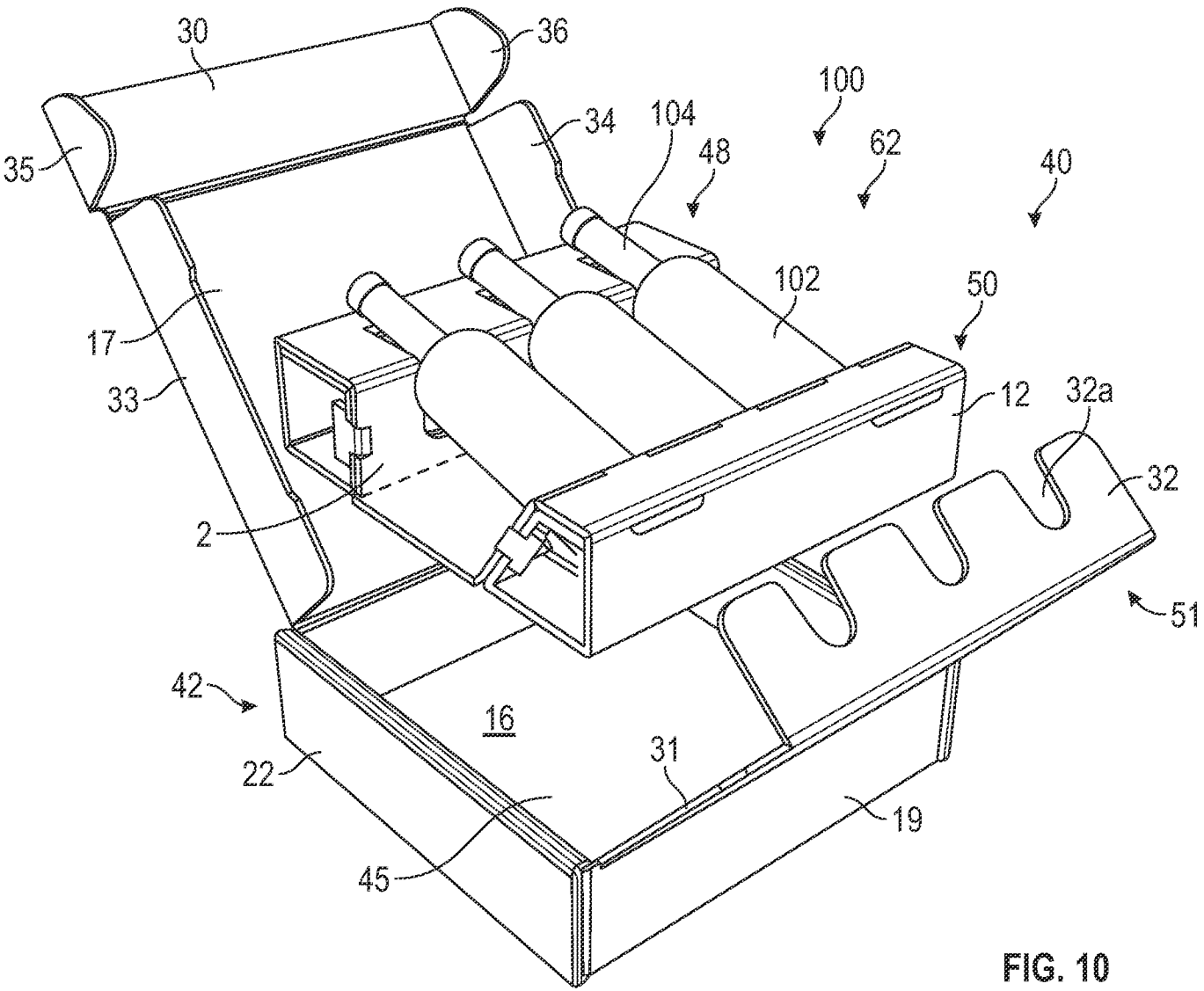
FIG. 10 is an exploded perspective view of the container assembly showing the insert of FIG. 6 together with three bottles therein exploded from the outer box.
Figure 11:
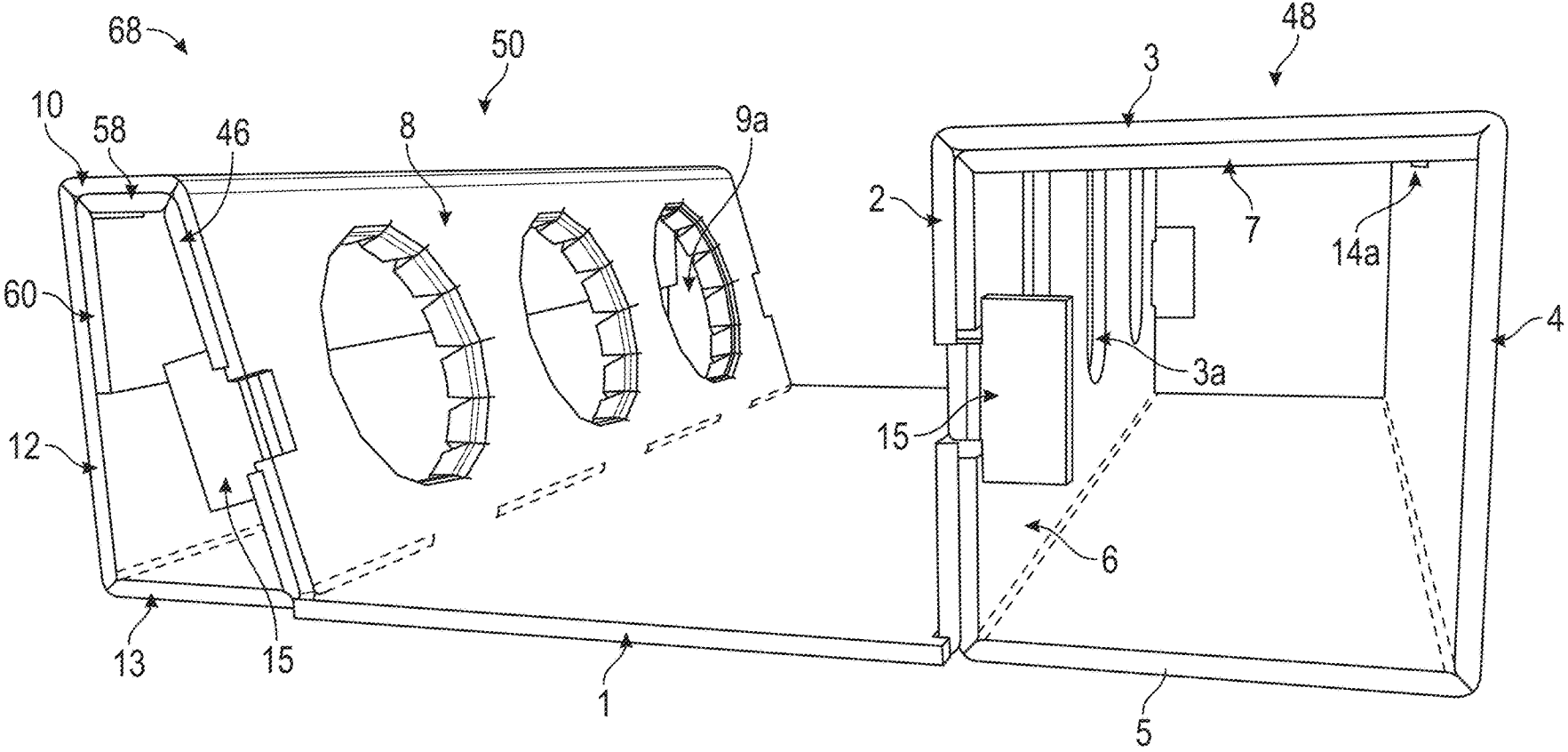
FIG. 11 is a plan view of another insert flat in accordance with a preferred embodiment of the present invention.
Figure 12:
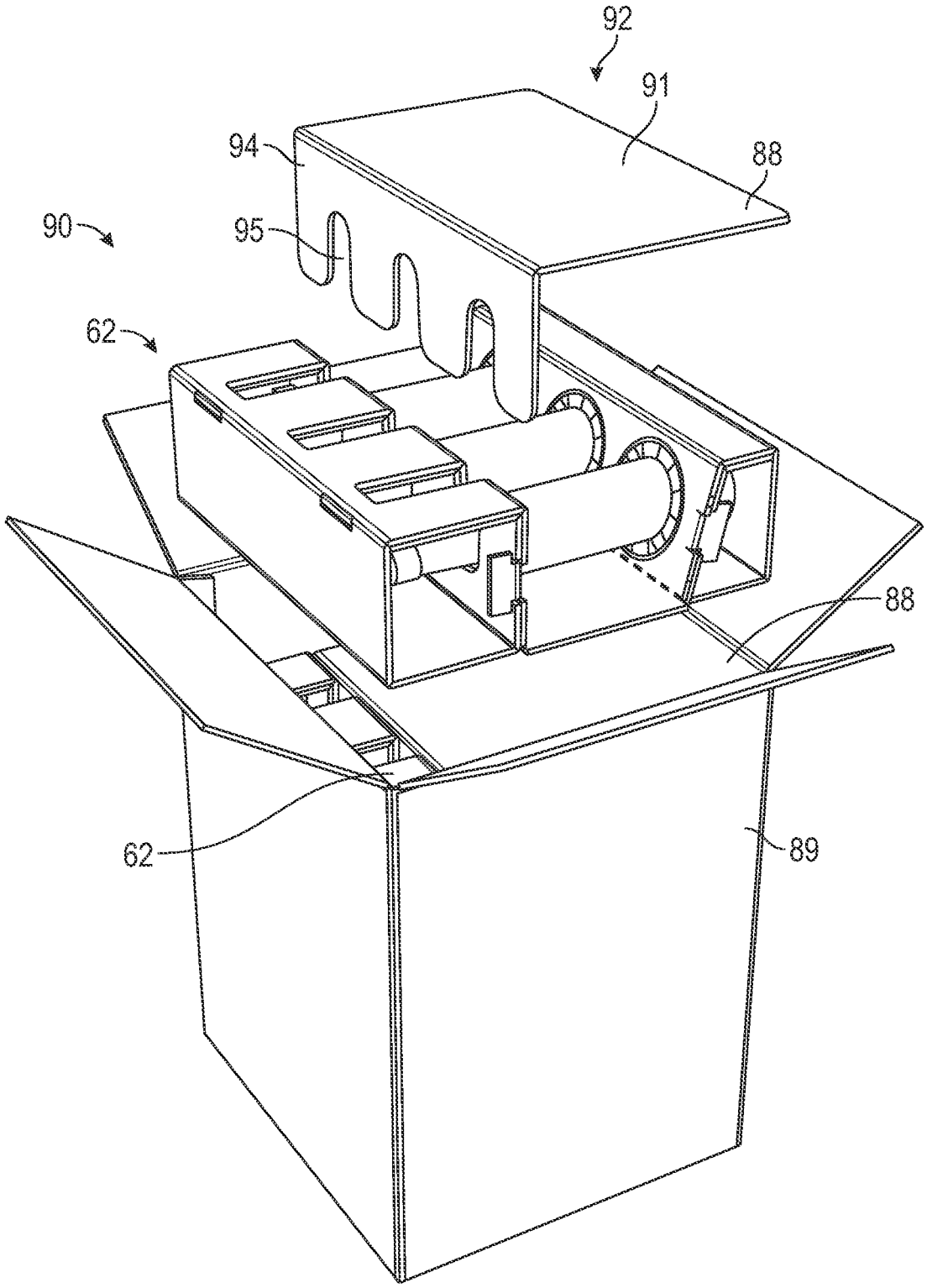
FIG. 12 is an exploded perspective view of a container assembly configured to receive multiple inserts together with a retainer member and the insert, with three bottles therein, exploded from the large box.

FIGS. 6-10 show another preferred embodiment of the present invention where the insert 62 includes some extra panels and tabs compared to insert 44 above. For example, the insert 62 includes a tab 52 for securing the lower retainer portion 50 in place. FIGS. 10-12 show the container assembly 40 that includes the outer box 42 and insert 62. The bottles are received in insert 62, and insert 62 is received in box interior 45. As shown in FIG. 10, the insert 62 is insertable into (and removable from) outer box 42. In a preferred embodiment, both the outer box 42 and insert 62 begin as a flat. The insert flat 64 is shown in FIG. 6 and the outer box flat 49 is shown in FIG. 3. It will be appreciated that the insert is numbered 62 in the assembled condition or position and is numbered 64 in the flat condition or position. FIGS. 6-9 show the insert flat 64 in the flat condition (FIG. 6), the assembled condition (FIGS. 7-8) and with bottles inserted therein (FIG. 9). Preferably, the insert flat and final assembled insert flat are formed from a single piece of material. Preferably, the outer box flat and final assembled outer box are formed from a single piece of material. However, separate pieces of material may be glued or otherwise adhered to one another to form the insert and the outer box.

FIGS. 6-9 together show the assembly of insert flat 64 into assembled insert 62. To form the upper retainer portion 48, panel 2 folds 90° from main panel 1. In use, the bottle shoulders rest against panel 2. Panel 3 folds 90° from panel 2. A first set of neck retaining slots 3*a* are formed in panels 2 and 3, and when panels 2 and 3 are folded with respect to one another, neck retaining slots 3*a* take the shape shown in FIG. 4 (together with the second set of neck retaining slots 7*a*, which are formed in panels 6 and 7). Panel 2 forms an inner wall of upper retainer portion 48 and exposes the bottle necks (through slots 3*a*). Panel 4 folds 90° from panel 3 (and opposes panel 2). Panel 3 forms the top wall of upper retainer portion 48. Panel 5 folds 90° from panel 4. Panel 4 is or forms the outer wall of upper retainer portion 48. Panel 6 folds 90° from panel 5. Panel 6 is a reinforcement for panel 2. Panel 7, folds 90° from panel 6. Panel 7 acts as a brace for panel 5 keeping panel 5 rigid against panel 1. Second neck retaining slots 7*a* align with first neck retaining slots 3*a* (to form a neck retaining tunnel 63) and receive the bottle necks during use. Tab 14 extends from panel 7 and corresponding slot 14*a* is defined in panel 4. Tab 14 is received in slot 14*a* to help secure upper retainer portion in the proper position and insure panel 7 cannot pivot out of position in panel 4. Tab or wing lock 15 is received in corresponding allowance or channel 15*a* and helps keep panels 2 through 7 in rolled form, as shown in FIGS. 7-8. This allows the insert to be handled while maintaining the functionality of the combined panels 2 through 7.

To form the lower retainer portion 50, panel 8 is back folded to achieve the appropriate angle necessary to accommodate the diameter of the inserted bottles (which can be any angle between 1° and 90°). Voids or bottom openings 9*a* are defined in panel 8 and provide a contour around the body of the inserted bottles aiding in the orientation, separation, and protection for the inserted bottles in transit. Panel 10 folds counter to panel 8 (which includes bottom openings 9*a* defined therein) and is generally parallel to panel 1. Panel 10, in use, acts to provide added protection beyond the protection of the outer box 42. Panel 12 folds 90° from panel 10 and is the outer most portion of protection for the bottom of the bottles. Panel 13 folds 90° from panel 12 to form the bottom of lower retainer portion 50. Panel 46 folds until flush against panel 8 and is a reinforcement for panel 8. Panel 46 includes a second set of bottle bottom openings 46*a* that align with the first set of bottle bottom openings 9*a* in panel 8 when the lower retainer member is in the assembly position. Tabs 11*a* and corresponding slots 11 are integrated into panels 58 and 12. Tabs 11*a* are inserted into slots 11 to insure panel 58 is connected to panel 12. Wing lock or tabs 52 are received and held within corresponding allowances or channels 52*a* to keep panels 8, 10, 12, 13, 46 and 58 in rolled form (FIGS. 7-8) allowing the insert 62 to be handled while maintaining the functionality of the combined panels in the lower retainer portion 50.

The description of the outer box 42 and out box flat 49 (see FIG. 3) is omitted with this embodiment as it is the same as is used with insert 44 above. After assembly of the outer box 42, as shown in FIGS. 10-12, insert 62 is inserted into the outer box 42 with panel 12 facing towards panel 19 (see FIG. 10). The bottle bottoms 102 are then inserted into voids or bottom openings 9*a* in panel 8 and the bottle necks 104 are inserted into slots 3*a* (see FIG. 9), which are defined in panels 2 and 3 (and slots 7*a*, which are defined in panels 6 and 7) on insert 62.

Next, the securing portion 51 is positioned to secure the insert 62 and bottles within the box interior. This is done by folding panels 31 and 32 from panel 19 and slots 32*a* on panel 32 are inserted over and receive the bottle necks. The slots 32*a* generally correspond to the neck of the inserted bottles when folded. After insertion, panel 32 is adjacent to and/or against panel 2. The securing portion 51 helps hold the bottles 100 in place during shipping and transport and panel 32, with the bottle necks extending through slots 32*a* helps prevent the bottles from traveling vertically (upwardly as FIG. 10 is oriented) in transit.

Lastly, the top of the outer box is closed. Panels 33 and 34 are dust flaps and fold 90° from panel 17. Panel 17 is the top of the outer box and folds 90°. Panel 30 is the front outer panel and folds 90°. Panels 35 and 36 are inserted into the gap created between panels 24, 25, 26 and 27 and panels 20 and 22 when securing the outer box 42 and container assembly 40 closed.

FIG. 11 shows another embodiment of an insert 68 that includes panel or portion 60 that folds from panel 58 and is interior to panel 12. Panel 58 provides thickness and further cushioning for the bottle bottoms.

With reference to FIG. 4, and as shown in FIGS. 1-5 (for insert 44), FIGS. 6-10 (for insert 62) and FIG. 11 (for insert 68), the container assembly 40 includes the outer box 42, which includes a bottom portion 74 having first wall 76, second wall 78, third wall 80 and fourth wall 82 and a bottom (e.g., panel 16) that cooperate to define a box interior 45. Outer box 42 also includes a top 84 pivotably connected to the first wall 76 of the bottom portion 74. The top 84 is movable between a closed position and an open position. The outer box 42 also preferably includes a securing portion 51 pivotably connected to any one of the second wall 78, third wall 80 or fourth wall 82. The securing portion 51 is movable between a non-securing position (FIG. 4) and a securing position. FIG. 5 shows the securing portion 51 just before reaching the securing position. In the securing position, panel 31 is generally parallel with panel 17 of the top 84 when it is in the closed position. Preferably, the securing portion 51 includes at least one neck slot 32*a* that is configured to receive the neck of the bottle when the securing portion 31 is in the securing position.

In a preferred embodiment, insert 44, 62 or 68 includes the upper retainer portion 48 having at least one neck retaining slot 7*a* defined therein. The neck retaining slot 7*a* are each configured to receive the neck of a bottle. The insert 44, 62 or 68 preferably also includes the lower retainer portion 50 that includes at least one bottom retaining opening 9*a* defined therein. Preferably, the bottom retaining openings 9*a* are each configured to receive the bottom of a bottle. In a preferred embodiment, the insert 44 also includes a main panel 86 (e.g., panel 1) extending between the upper retainer portion 48 and the lower retainer portion 50. It will be appreciated that the terms upper, lower and bottom in the upper retainer portion 48, the lower retainer portion 50 and the bottom retaining openings 9*a* refer to the orientation with respect to the bottles in the insert 44, 62 or 68 and the terms top and bottom in the top 84 and bottom portion 74 refer to the orientation with respect to when the outer box 42 is oriented with the bottom portion 74 on a flat surface, such as is shown in FIGS. 4 and 10.

In a preferred embodiment, when the insert 44 is received in the box interior 45, the securing portion 51 is positioned over at least a portion of the insert 44 in the securing position, and the top 84 is positioned over the securing portion 51 in the closed position.

Figure 13:
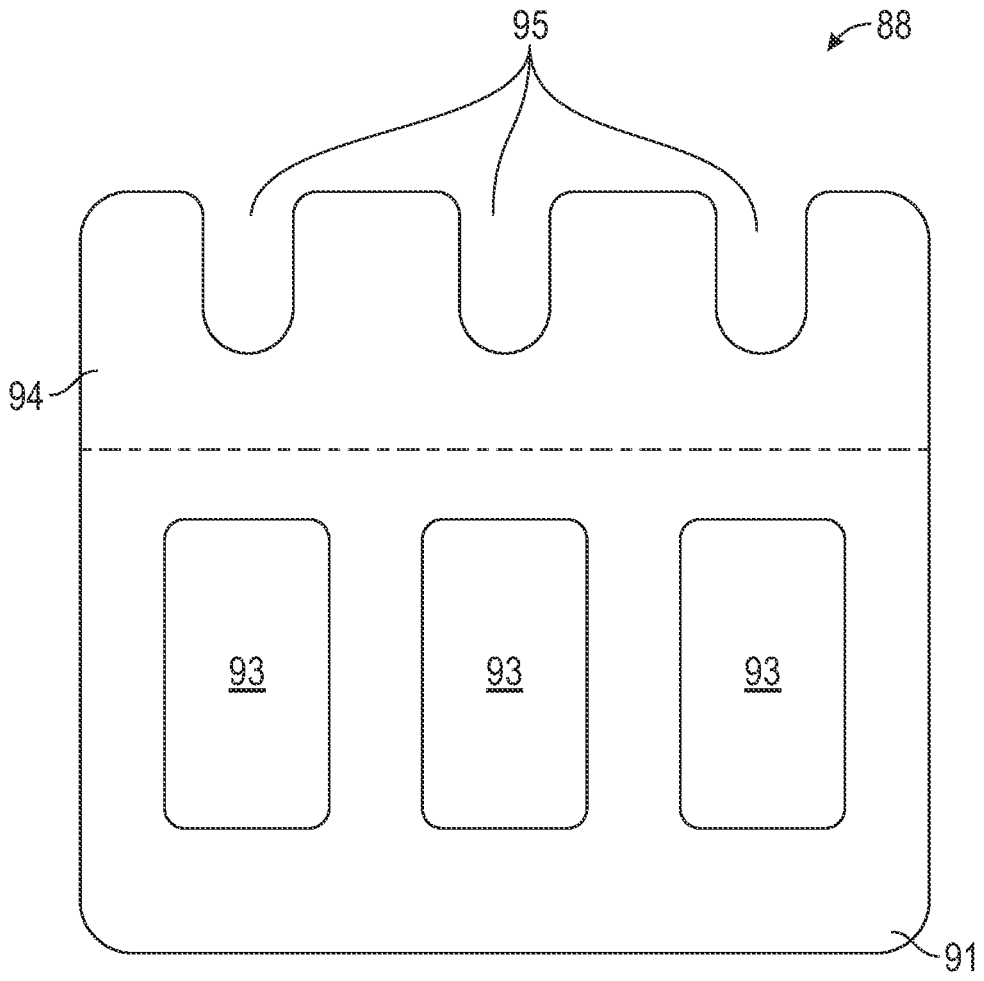
FIG. 13 is a plan view of the retainer member flat.

FIGS. 12-13 show a retainer member 88 for use with a large box 89 that can be used to include and ship multiple sets of bottles in two or more inserts 44, 62 or 68, as described herein. With the addition or use of two or more separate retainer members 70 (which resembles panels 31 and 32 in FIG. 4), the retainer assembly 92 (retainer member 70 with insert 44, 62 or 68) can be stacked in multiples within a common shipper (RSC) or large box 89 (replacing outer box 42) and allowing for up to twelve bottles (or more) to be shipped via commercial carrier.

A multiple insert box assembly 90 in accordance with the present invention includes one or more retainer assemblies 92 (which includes a retainer member 88 and an insert 62) inside of a large box 89. In an embodiment of the invention, retainer member 88 can include openings 93 therein. Preferably, the retainer member 88 includes a main panel 91, a secondary panel 94 and one or more neck slots 95.

The multiple insert box assembly 90 includes large box 89 that defines a box interior, a first insert 62 (with a first bottle therein) inserted into the box interior, a first retainer member 88 placed on the first insert 62, such that the main panel 91 covers at least a portion of the bottles in the first insert 62 and the secondary panel is approximately 90 degrees from the main panel. The neck slot 95 defined in the secondary panel is positioned over the neck of the bottle. A second insert 62 may be placed over the first retainer member and a second retainer member may be placed over the second insert 62.

Unless the context clearly requires otherwise, throughout the description and the claims, the words "comprise," "comprising," and the like are to be construed in an inclusive sense, as opposed to an exclusive or exhaustive sense; that is to say, in the sense of "including, but not limited to." As used herein, the terms "connected," "coupled," or any variant thereof, means any connection or coupling, either direct or indirect, between two or more elements; the coupling of connection between the elements can be physical, logical, or a combination thereof. Additionally, the words "herein," "above," "below," and words of similar import, when used in this application, shall refer to this application as a whole and not to any particular portions of this application. Where the context permits, words in the above Detailed Description of the Preferred Embodiments using the singular or plural number may also include the plural or singular number respectively. The word "or" in reference to a list of two or more items, covers all of the following interpretations of the word: any of the items in the list, all of the items in the list, and any combination of the items in the list.

The above-detailed description of embodiments of the disclosure is not intended to be exhaustive or to limit the teachings to the precise form disclosed above. While specific embodiments of and examples for the disclosure are described above for illustrative purposes, various equivalent modifications are possible within the scope of the disclosure, as those skilled in the relevant art will recognize. Further, any specific numbers noted herein are only examples: alternative implementations may employ differing values, measurements or ranges.

Although the operations of any method(s) disclosed or described herein either explicitly or implicitly are shown and described in a particular order, the order of the operations of each method may be altered so that certain operations may be performed in an inverse order or so that certain operations may be performed, at least in part, concurrently with other operations. In another embodiment, instructions or sub-operations of distinct operations may be implemented in an intermittent and/or alternating manner.

The teachings of the disclosure provided herein can be applied to other systems, not necessarily the system described above. The elements and acts of the various embodiments described above can be combined to provide further embodiments. Any measurements or dimensions described or used herein are merely exemplary and not a limitation on the present invention. Other measurements or dimensions are within the scope of the invention.

Any patents and applications and other references noted above, including any that may be listed in accompanying filing papers, are incorporated herein by reference in their entirety. Aspects of the disclosure can be modified, if necessary, to employ the systems, functions, and concepts of the various references described above to provide yet further embodiments of the disclosure.

These and other changes can be made to the disclosure in light of the above Detailed Description of the Preferred Embodiments. While the above description describes certain embodiments of the disclosure, and describes the best mode contemplated, no matter how detailed the above appears in text, the teachings can be practiced in many ways. Details of the system may vary considerably in its implementation details, while still being encompassed by the subject matter disclosed herein. As noted above, particular terminology used when describing certain features or aspects of the disclosure should not be taken to imply that the terminology is being redefined herein to be restricted to any specific characteristics, features or aspects of the disclosure with which that terminology is associated. In general, the terms used in the following claims should not be construed to limit the disclosures to the specific embodiments disclosed in the specification unless the above Detailed Description of the Preferred Embodiments section explicitly defines such terms. Accordingly, the actual scope of the disclosure encompasses not only the disclosed embodiments, but also all equivalent ways of practicing or implementing the disclosure under the claims.

While certain aspects of the disclosure are presented below in certain claim forms, the inventors contemplate the various aspects of the disclosure in any number of claim forms. For example, while only one aspect of the disclosure is recited as a means-plus-function claim under 35 U.S.C. § 112, ¶6, other aspects may likewise be embodied as a means-plus-function claim, or in other forms, such as being embodied in a computer-readable medium. (Any claims intended to be treated under 35 U.S.C. § 112, ¶6 will include the words "means for"). Accordingly, the applicant reserves the right to add additional claims after filing the application to pursue such additional claim forms for other aspects of the disclosure.

Accordingly, although exemplary embodiments of the invention have been shown and described, it is to be understood that all the terms used herein are descriptive rather than limiting, and that many changes, modifications, and substitutions may be made by one having ordinary skill in the art without departing from the spirit and scope of the invention.

What is claimed is:

1. A container assembly for securing a bottle having a bottom and a neck, the container assembly comprising:

an outer box that includes:

a bottom portion having first, second, third and fourth walls and a bottom that cooperate to define a box interior, a top connected to the first wall of the bottom portion, wherein the top is movable between a closed position and an open position, and a securing portion that includes a first panel that is connected to one of the second, third or fourth walls and a second panel that is connected to the first panel, wherein the securing portion is movable between a non-securing position and a securing position, wherein the securing portion includes a neck slot that is defined in the second panel and is configured to receive the neck of the bottle when the securing portion is in the securing position, and wherein the second panel is positioned between the upper retainer portion and the lower retainer portion when the securing portion is in the securing position, an insert that includes:

an upper retainer portion having a neck retaining slot defined therein, wherein the neck retaining slot is configured to receive the neck of the bottle, a lower retainer portion having a bottom retaining opening defined therein, wherein the bottom retaining opening is configured to receive the bottom of the bottle, and a main panel extending between the upper and lower retainer portions, and wherein when the insert is received in the box interior, the securing portion is positioned over at least a portion of the insert in the securing position, and the top is positioned over the securing portion in the closed position.

2. The container assembly of claim 1 wherein the upper retainer portion, lower retainer portion and main panel are formed from a one-piece insert flat.

3. The container assembly of claim 2 wherein the upper retainer portion includes a first panel connected to the main panel, wherein the neck retaining slot is at least partially defined in the first panel of the upper retainer portion, wherein the lower retainer portion includes a first panel connected to the main panel, wherein the bottom retaining opening is defined in the first panel of the lower retainer portion.

4. A container assembly for securing a bottle having a bottom and a neck, the container assembly comprising:

an outer box that includes:

a bottom portion having first, second, third and fourth walls and a bottom that cooperate to define a box interior, a top connected to the first wall of the bottom portion, wherein the top is movable between a closed position and an open position, and a securing portion connected to one of the second, third or fourth walls, wherein the securing portion is movable between a non-securing position and a securing position, wherein the securing portion includes a neck slot that is configured to receive the neck of the bottle when the securing portion is in the securing position, an insert that includes:

an upper retainer portion having a first panel connected to the main panel, a second panel connected to the first panel, a third panel connected to the second panel, a fourth panel connected to the third panel, a fifth panel connected to the fourth panel, and a sixth panel connected to the fifth panel, wherein a first neck retaining slot is defined in the first and second panels of the upper retainer portion, wherein a second neck retaining slot is defined in the fifth and sixth panels of the upper retainer portion, and wherein the first neck retaining slot is aligned with the second neck retaining slot to define a neck retaining tunnel, wherein the neck retaining tunnel is configured to receive the neck of the bottle, a lower retainer portion having a bottom retaining opening defined therein, wherein the bottom retaining opening is configured to receive the bottom of the bottle, and a main panel extending between the upper and lower retainer portions, and wherein when the insert is received in the box interior, the securing portion is positioned over at least a portion of the insert in the securing position, and the top is positioned over the securing portion in the closed position.

5. The container assembly of claim 1 wherein the upper retainer portion is comprised of a series of panels that are connected to the main panel, and wherein the lower retainer portion is comprised of a series of panels that are connected to the main panel.

6. The container assembly of claim 4 wherein the lower retainer portion includes a first panel connected to the main panel, a second panel connected to the first panel, a third panel connected to the second panel, and a fourth panel connected to the third panel, wherein a first bottle bottom opening is defined in the first panel of the lower retainer portion.

7. The container assembly of claim 6 wherein the first panel of the upper retainer portion includes a tab extending therefrom, wherein the fifth panel of the upper retainer portion includes a channel defined therein, and wherein the tab is received in the channel to secure the upper retainer portion.

8. The container assembly of claim 6 wherein the lower retainer portion includes a fifth panel connected to the fourth panel, and a sixth panel connected to the fifth panel, wherein the first panel of the lower retainer portion includes a tab extending therefrom, wherein the fifth panel of the lower retainer portion includes a channel defined therein, and wherein the tab is received in the channel to secure the lower retainer portion.

9. The container assembly of claim 6 wherein the lower retainer portion includes a fifth panel connected to the fourth panel, a sixth panel connected to the fifth panel, and a seventh panel connected to the sixth panel, and wherein the seventh panel is positioned adjacent the third panel, whereby a bottle extending through the first bottle bottom opening rests against the seventh panel.

* * * * *